US009938725B2

(12) United States Patent
Johnson et al.

(10) Patent No.: US 9,938,725 B2
(45) Date of Patent: Apr. 10, 2018

(54) BUILDING PANEL

(71) Applicant: Kingspan Insulated Panels, Inc., Deland, FL (US)

(72) Inventors: Patrick Johnson, Deland, FL (US); Gabriel Morris, Aurora (CA); Peter Martin, Deland, FL (US); Andrew Hamer, Deland, FL (US); Brian Glancy, Toronto (CA)

(73) Assignee: Kingspan Insulated Panels, Inc., Deland, FL (US)

( * ) Notice: Subject to any disclaimer, the term of this patent is extended or adjusted under 35 U.S.C. 154(b) by 0 days.

(21) Appl. No.: 15/142,277

(22) Filed: Apr. 29, 2016

(65) Prior Publication Data

US 2016/0326749 A1 Nov. 10, 2016

Related U.S. Application Data

(60) Provisional application No. 62/156,542, filed on May 4, 2015.

(51) Int. Cl.
*E04B 2/00* (2006.01)
*E04F 13/08* (2006.01)

(52) U.S. Cl.
CPC ..... *E04F 13/0876* (2013.01); *E04F 13/0832* (2013.01); *E04F 13/0866* (2013.01); *E04F 13/0894* (2013.01); *E04F 13/0898* (2013.01)

(58) Field of Classification Search
CPC ..... E04F 13/0876; E04F 13/0832; E04F 13/0898; E04F 13/0894; E04F 13/0866
USPC ..... 52/506.05, 235, 302.1, 302.4
See application file for complete search history.

(56) References Cited

U.S. PATENT DOCUMENTS

| | | | |
|---|---|---|---|
| 2,818,948 | A | 1/1958 | Jones |
| 3,080,021 | A | 3/1963 | Muir |
| 3,300,934 | A | 1/1967 | Waizenhofer |
| 3,310,926 | A | 3/1967 | Brandreth et al. |
| 3,324,617 | A | 6/1967 | Knight et al. |
| 3,417,531 | A | 12/1968 | Jones |
| 3,438,168 | A | 4/1969 | Tischuk |
| 3,474,583 | A | 10/1969 | Manias |
| 3,522,683 | A | 8/1970 | Wise |
| 3,554,142 | A | 1/1971 | Sorenson |

(Continued)

FOREIGN PATENT DOCUMENTS

| | | |
|---|---|---|
| CN | 201254808 | 6/2009 |
| CN | 202787849 | 3/2013 |

(Continued)

*Primary Examiner* — Basil S Katcheves
(74) *Attorney, Agent, or Firm* — Harness, Dickey & Pierce, P.L.C.

(57) ABSTRACT

A building panel has an outer skin spaced from an inner skin, sandwiching an insulation material. A first end of the outer skin includes a step portion, an indented fastener receiving portion and a first flange. The first flange extends outwardly toward a surface of the outer skin. A seal is mounted on the first flange. The inner skin includes a first end. The inner skin first end includes a shelf and a second flange extending from the shelf. A second seal is positioned on the second flange. A second end of the outer skin includes a portion to receive an outer skin first end of an adjoining panel. A second end of the inner skin includes a portion to receive an inner skin first end of the adjoining panel.

12 Claims, 6 Drawing Sheets

(56) References Cited

U.S. PATENT DOCUMENTS

| | | | |
|---|---|---|---|
| 3,555,762 | A | 1/1971 | Costanzo, Jr. |
| 3,621,635 | A | 11/1971 | Lange |
| 3,667,180 | A | 6/1972 | Tischuk |
| 3,678,642 | A | 7/1972 | Scott |
| 3,760,548 | A | 9/1973 | Sauer |
| 3,971,326 | A | 7/1976 | Svirklys |
| 3,998,016 | A | 12/1976 | Ting |
| 4,126,354 | A | 11/1978 | DeLong |
| 4,133,158 | A | 1/1979 | Ting |
| 4,250,678 | A | 2/1981 | Skuran |
| 4,641,468 | A | 2/1987 | Slater |
| 4,700,520 | A | 10/1987 | Ting |
| 4,866,896 | A | 9/1989 | Shreiner et al. |
| 4,928,467 | A | 5/1990 | Hintsa |
| 4,936,078 | A | 6/1990 | Porter |
| 4,961,295 | A | 10/1990 | Kosch, Sr. et al. |
| 5,220,759 | A | 6/1993 | Hossli |
| 5,373,678 | A | 12/1994 | Hesser |
| 5,425,210 | A | 6/1995 | Zafir |
| 5,544,461 | A | 8/1996 | Sommerstein |
| 5,638,651 | A | 6/1997 | Ford |
| 5,678,369 | A | 10/1997 | Ishikawa et al. |
| 5,749,282 | A | 5/1998 | Brow et al. |
| 5,809,729 | A | 9/1998 | Mitchell |
| 5,956,910 | A | 9/1999 | Sommerstein et al. |
| 6,035,598 | A | 3/2000 | Sukolics et al. |
| 6,070,382 | A | 6/2000 | Ettema |
| 6,082,810 | A | 7/2000 | Bennett |
| 6,202,377 | B1 | 3/2001 | Krieger |
| 6,226,947 | B1 | 5/2001 | Bado et al. |
| 6,253,511 | B1 | 7/2001 | Boyer |
| 6,279,287 | B1 | 8/2001 | Meadows |
| 6,460,311 | B1 | 10/2002 | Ito |
| 6,470,647 | B2 | 10/2002 | Hsueh |
| 6,484,465 | B2 | 11/2002 | Higgins |
| 6,564,521 | B1 | 5/2003 | Brown |
| 6,805,185 | B2 | 10/2004 | Gravel |
| 6,895,721 | B2 | 5/2005 | Watanabe et al. |
| D527,834 | S | 9/2006 | Thimons et al. |
| D531,012 | S | 10/2006 | Shih |
| D538,948 | S | 3/2007 | Timons et al. |
| 7,526,903 | B2 | 5/2009 | Kandasamy |
| D608,181 | S | 1/2010 | Koizumi |
| 7,716,891 | B2 | 5/2010 | Radford |
| 7,748,181 | B1 | 7/2010 | Guinn |
| 7,805,899 | B2 | 10/2010 | Montgomery |
| 7,810,289 | B2 | 10/2010 | Montgomery |
| 7,856,790 | B2 | 12/2010 | Jambois et al. |
| D641,894 | S | 7/2011 | Bragg |
| 8,029,880 | B2 | 10/2011 | Liu |
| 8,033,066 | B2 | 10/2011 | Griffiths |
| 8,117,801 | B2 | 2/2012 | Jambois et al. |
| D662,805 | S | 7/2012 | Madonald et al. |
| 8,240,099 | B2 | 8/2012 | Hummel, III |
| 8,327,593 | B2 | 12/2012 | Laprise |
| 8,336,273 | B2 | 12/2012 | Enns |
| 8,511,014 | B2 | 8/2013 | Delforte |
| 8,621,810 | B2 | 1/2014 | Manser et al. |
| D704,862 | S | 5/2014 | Boccuzzi et al. |
| 9,347,225 | B2 | 5/2016 | Glancy et al. |
| 9,499,978 | B2 | 11/2016 | Glancy |
| 2002/0124514 | A1 | 9/2002 | Higgins |
| 2004/0010998 | A1 | 1/2004 | Turco |
| 2004/0134143 | A1* | 7/2004 | Boyer ..... E04C 2/292 52/235 |
| 2004/0216416 | A1 | 11/2004 | Hohmann et al. |
| 2005/0210800 | A1 | 9/2005 | Wobber |
| 2006/0037282 | A1 | 2/2006 | Layfield |
| 2006/0117689 | A1 | 6/2006 | Onken |
| 2007/0022682 | A1 | 2/2007 | Morgenegg et al. |
| 2008/0083180 | A1 | 4/2008 | Miller |
| 2008/0127586 | A1 | 6/2008 | Carolan |
| 2009/0019805 | A1 | 1/2009 | Zanelli |
| 2009/0031652 | A1 | 2/2009 | Ortega Gatalan |
| 2009/0241444 | A1 | 10/2009 | Griffiths |
| 2010/0170173 | A1* | 7/2010 | Boyer ..... E04B 1/4178 52/235 |
| 2010/0205883 | A1 | 8/2010 | Carson |
| 2010/0229484 | A1 | 9/2010 | Carolan et al. |
| 2010/0263314 | A1 | 10/2010 | MacDonald et al. |
| 2012/0186170 | A1 | 7/2012 | MacDonald et al. |
| 2012/0216471 | A1 | 8/2012 | Manser |
| 2013/0205698 | A1 | 8/2013 | Todd et al. |

FOREIGN PATENT DOCUMENTS

| | | |
|---|---|---|
| DE | 20201100302 | 7/2011 |
| EP | 1179645 | 10/2005 |
| GB | 2 135 708 | 9/1984 |
| GB | 2 313 389 | 11/1997 |
| JP | 2005-90137 | 4/2005 |
| WO | WO96/24734 | 8/1996 |
| WO | WO2004/101907 | 11/2004 |
| WO | WO2008/127207 | 10/2008 |

* cited by examiner

BUILDING PANEL

CROSS-REFERENCE TO RELATED APPLICATION

This application claims the benefit of U.S. Provisional Application No. 62/156,542, filed on May 4, 2015. The entire disclosure of the above application is incorporated herein by reference.

FIELD

The present disclosure relates to a building panel and, more particularly, to an insulated building panel having mating ends.

BACKGROUND

Various types of building panels exist in the art. These building panels are utilized for exterior walls to form a building by bolting the panels onto a frame structure. Ordinarily, the panels include an inner skin and an outer skin with an insulated material bonded in between the two skins. The building panels are stacked one upon the other until the desired height of the building is achieved.

Different types of ends have been utilized to join the panels together. Ordinarily, some type of mating arrangement is provided on both ends of the panel. The ends are mated with reciprocal ends of an adjoining panel. Thus, the building can be constructed in a relatively expedited fashion.

The building walls include various types of sealing arrangements at the ends. The sealing arrangements may include seals, caulking or the like positioned between adjacent panels. The sealing arrangements have been satisfactory. However, designers are always striving to improve the art.

The present disclosure provides the art with a building panel including mating ends. The building panel includes a bump out to conceal the fastener head from view. Additionally, the building panel includes an indented portion to receive a fastener head. The seals are spaced from the insulated material.

SUMMARY

According to the disclosure, a building panel comprises an outer skin spaced from an inner skin. An insulated material is positioned between and bonded with the outer skin and inner skin to form the building panel. A first end of the outer skin includes a contoured portion. The contoured portion extends from a first surface of the outer skin. It includes a stepped portion, an indented fastener receiving portion and a flange portion. The flange portion extends outwardly from the indented portion towards the first surface of the outer skin. A seal is mounted on the flange portion. The inner skin includes a first end portion adjacent the first end of the outer skin. The inner skin first end includes a shelf extending towards the outer skin from a first surface of the inner skin. A flange extends from the shelf. The flange extends in the same direction as the outer skin flange. A second seal is positioned on the inner skin flange. A second end of the outer skin includes a portion to receive the first end of the outer skin of an adjoining panel. A second end of the inner skin includes a portion to receive the inner skin first end of an adjoining panel. The indented portion has a depth to receive a head of a fastener so that the head is at least flush with a plane passing through the flange of the outer skin. The insulation terminates at the inner skin shelf with the inner skin flange on one side of the inner skin shelf and the outer skin flange on the other side of the inner skin shelf. The outer skin contour portion includes a second step adjacent the first step to conceal the fastener head from view. The indented fastener receiving portion provides a gutter. The indented fastener receiving portion is positioned adjacent a terminus of the insulation at the second end of an adjoining panel.

According to a second aspect of the disclosure, a building wall comprises a plurality of insulated panels stacked one on another to form the building wall. Each insulated panel comprises an outer skin spaced from an inner skin. An insulated material is positioned between and bonded with the outer skin and inner skin to form the building panel. A first end of the outer skin includes a contoured portion. The contoured portion extends from a first surface of the outer skin. It includes a stepped portion, an indented fastener receiving portion and a flange portion. The flange portion extends outwardly from the indented portion towards the first surface of the outer skin. A seal is mounted on the flange portion. The inner skin includes a first end portion adjacent the first end of the outer skin. The inner skin first end includes a shelf extending towards the outer skin from a first surface of the inner skin. A flange extends from the shelf. The flange extends in the same direction as the flange of the outer skin. A second seal is positioned on the inner skin flange. A second end of the outer skin includes a portion to receive the first end of the outer skin of an adjoining panel. A second end of the inner skin includes a portion to receive the inner skin first end of an adjoining panel. The indented portion has a depth to receive a head of a fastener so that the head is at least flush with a plane passing through the flange of the outer skin. The insulation terminates at the inner skin shelf with the inner skin flange on one side of the shelf and the outer skin flange on the other side of the shelf. The outer skin contour portion includes a second step adjacent the first step to conceal the fastener head from view. The indented fastener receiving portion provides a gutter. The indented fastener receiving portion is positioned adjacent a terminus of the insulation at the second end of an adjoining panel.

According to a third aspect of the disclosure, a joint clip for securing a building panel to a frame structure comprises a base having at least one aperture. A pair of walls extend from the longitudinal sides of the base. The walls and base define a cavity. A resilient pad is positioned in the cavity to seal a fastener passing through the base aperture. A fastener passes through the base aperture and pad to secure the clip to a frame structure and, in turn, secure a building panel on the frame structure.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

DETAILED DESCRIPTION

Figure 1:
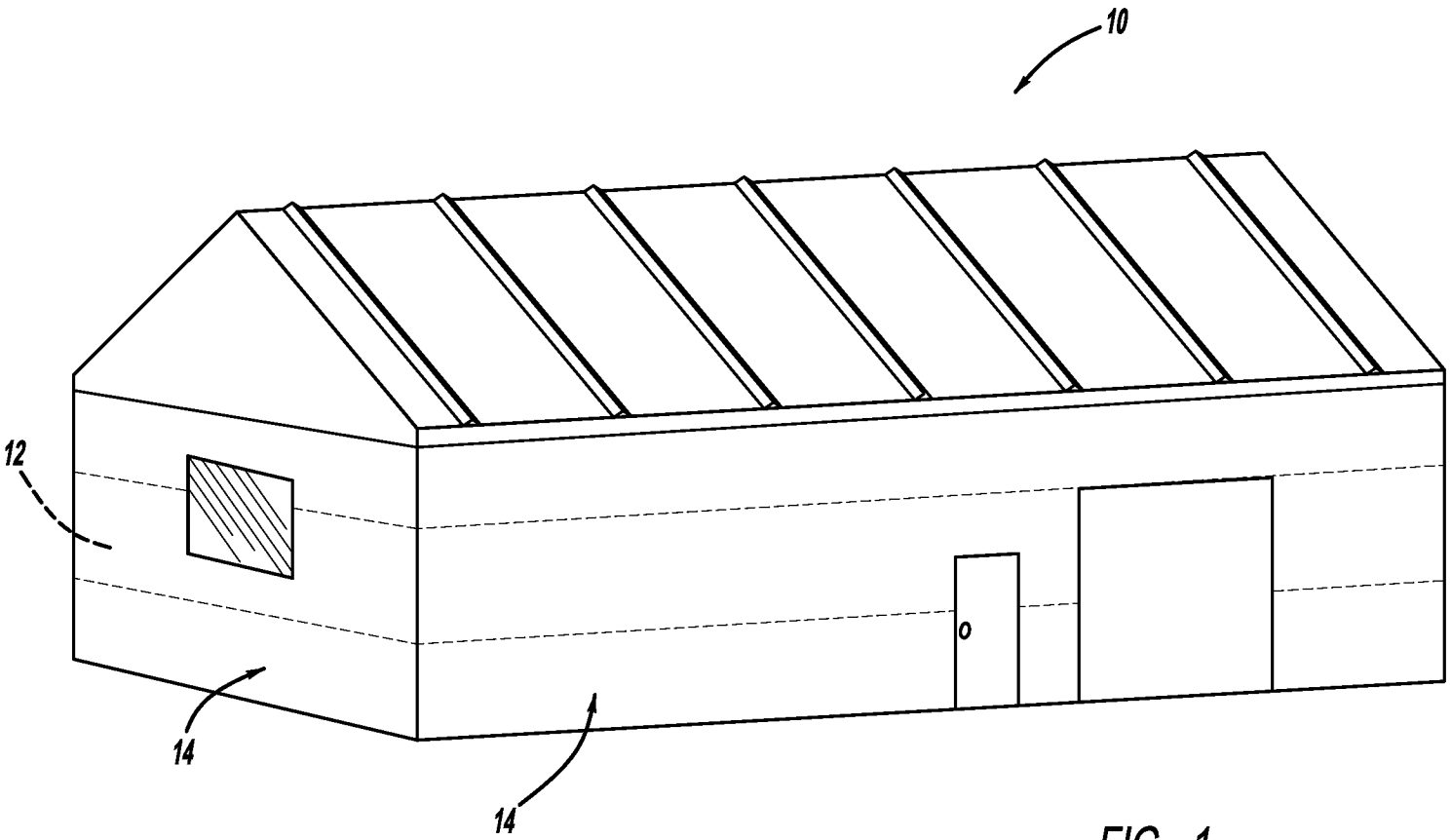
FIG. 1 is a perspective view of a building including the panels of the disclosure.

Turning to the figures, a building is illustrated with the reference numeral 10. The building includes a plurality of building panels 12. The building panels 12 are positioned or stacked adjacent one another to form a building wall 14 of the building 10. The panels 12 are positioned onto a framing structure 16 that provides the internal framework of the building.

Each panel 12 has an overall rectangular configuration with a desired length, height and thickness. The panel's desired length is up to approximately 60 feet. The width of the panel ranges between 2 to 6 feet. The thickness of the panels ranges between 2 inches to 6 inches.

Each panel 12 includes an outer skin 20 and an inner skin 22. An insulating material 24 is positioned between and bonded to the two skins 20, 22. The insulated panel 12 is manufactured by an expanding foam cured between the two skins 20, 22.

The skin 20 includes a major planar surface 26 that may be embossed or the like to include a pattern, if desired. The major planar surface 26 has a first end 28 and a second end 30. The first end 28, running the length of the panel 12, includes a contoured portion 32. The contoured portion 32 includes a first step portion 34. The first step portion 34 includes a tread 36 that is sloped with respect to the major surface 26. This enhances water drainage. A riser 38 of the step extends substantially parallel to the major surface 26.

An indented fastener receiving portion 40 is continuous with the first step portion 34. The indented fastener receiving portion 40 includes a second step 42 with a tread 44 and a riser 46. The riser 46 provides a receiving surface for the fasteners 48. The tread 44 is angled with respect to the riser 46 to enhance drainage. The fastener receiving portion 40 also acts as a pressure equalization chamber. The fastener 48 passes through the panel 12 and is secured with the frame structure 16.

A third tread 50 extends from the riser 46 towards the major face 26 of the outer skin 20. A third riser forming a flange 52 extends substantially perpendicular to the third tread 50. Also, the flange 52 is substantially parallel with the major surface 26 of the outer skin 20. The flange 52 is on a plane that passes through the indented fastener receiving portion 40 such that the fastener head 106 is at least flush with or below the plane passing through the flange 52. A seal 54 is positioned on the flange 52.

The second end of the major surface 26 terminates in a shelf 56. The shelf 56 is substantially perpendicular to the major surface 26. The shelf 56 extends inward from the major surface 26 toward the inner skin 22. A receiving portion 58 has a leg 59 and a hook 60 that receive the seal 54. The seal 54 is positioned in the hook portion 60 to mate with a second end of an adjoining panel 12. A gap 62 is formed between the flange 52 and foam 24. The foam surface is generally parallel to the major surface 26. This provides a pressure equalization chamber between the panels 12.

The inner skin 22 includes a major surface 66. The major surface 66 includes a first end 68 and a second end 70. The first end 68 terminates at a step portion 72. The step portion 72 includes a tread 73 substantially perpendicular to the major surface 66. A riser 74 extends from the tread 73. The riser 74, forming a flange, is substantially perpendicular to the tread 73. A seal 76 is positioned onto the flange 74. The flange 74 is positioned on one side of the terminus of the insulated material 24 while the flange 52 is positioned on the other side.

The second end of the major surface 66 includes a shelf 78. The shelf 78 extends toward the outer skin 20. The shelf 78 is substantially perpendicular to the major surface 66. A seal receiving portion 80 extends from the shelf 78. The seal receiving portion 80 includes a leg portion 82 and a hook portion 84. The leg portion 82 extends perpendicular to the shelf 78. The hook portion 84 receives the seal 76.

Figure 2:
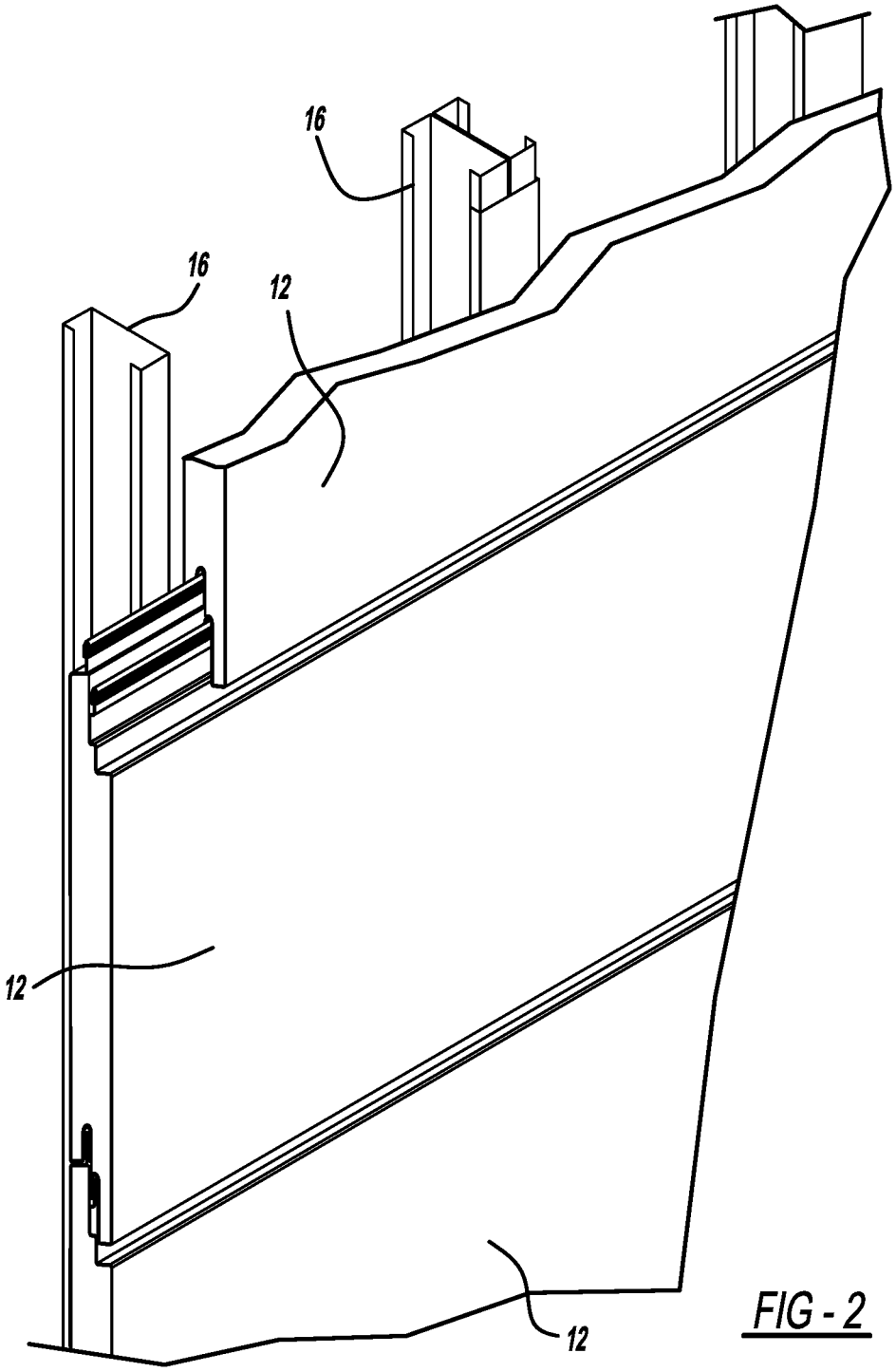
FIG. 2 is a perspective view partially in cross-section of a building wall with the building panels stacked on one another.
Figure 3:
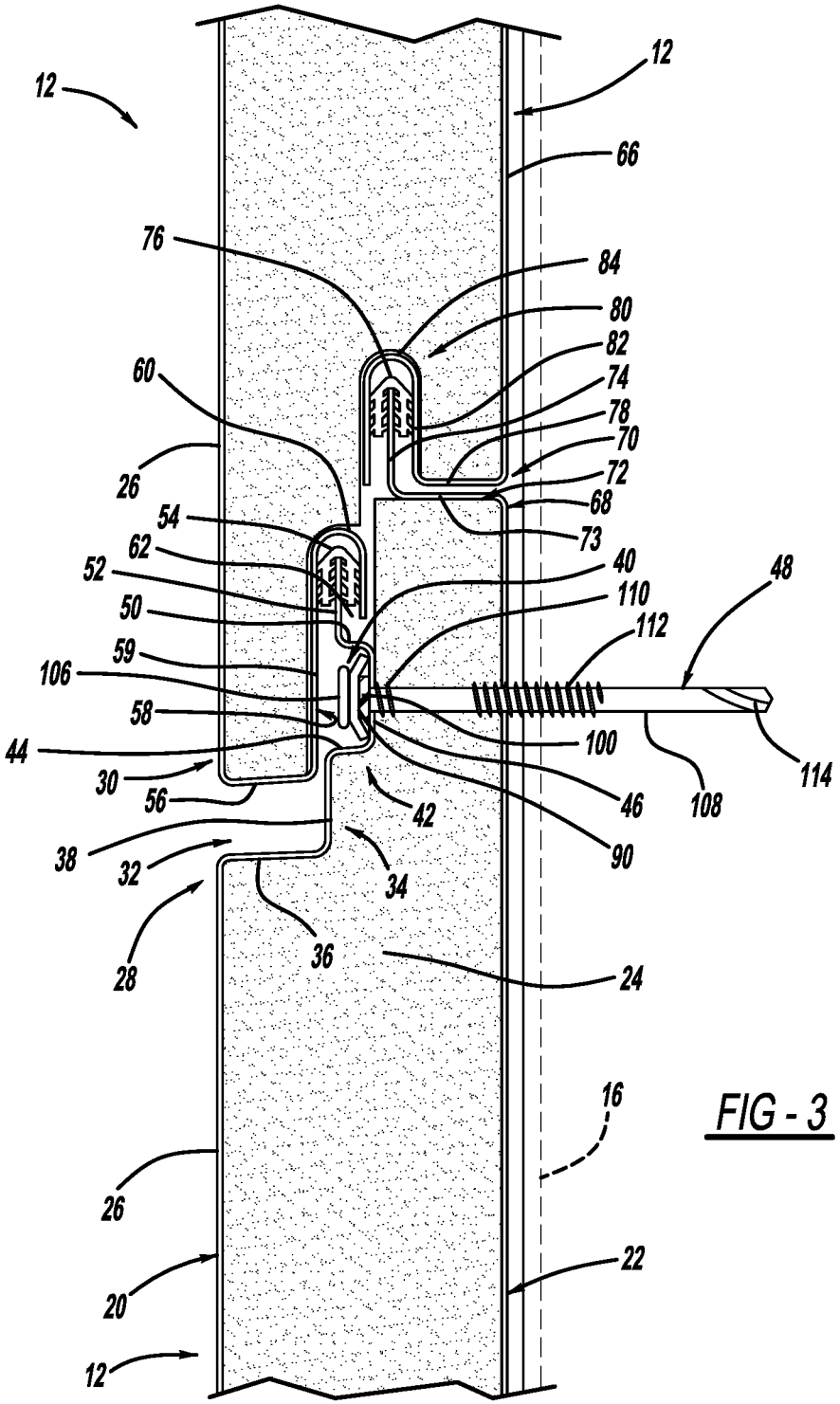
FIG. 3 is a cross-section view of the mating ends of the panel.
Figure 4A:
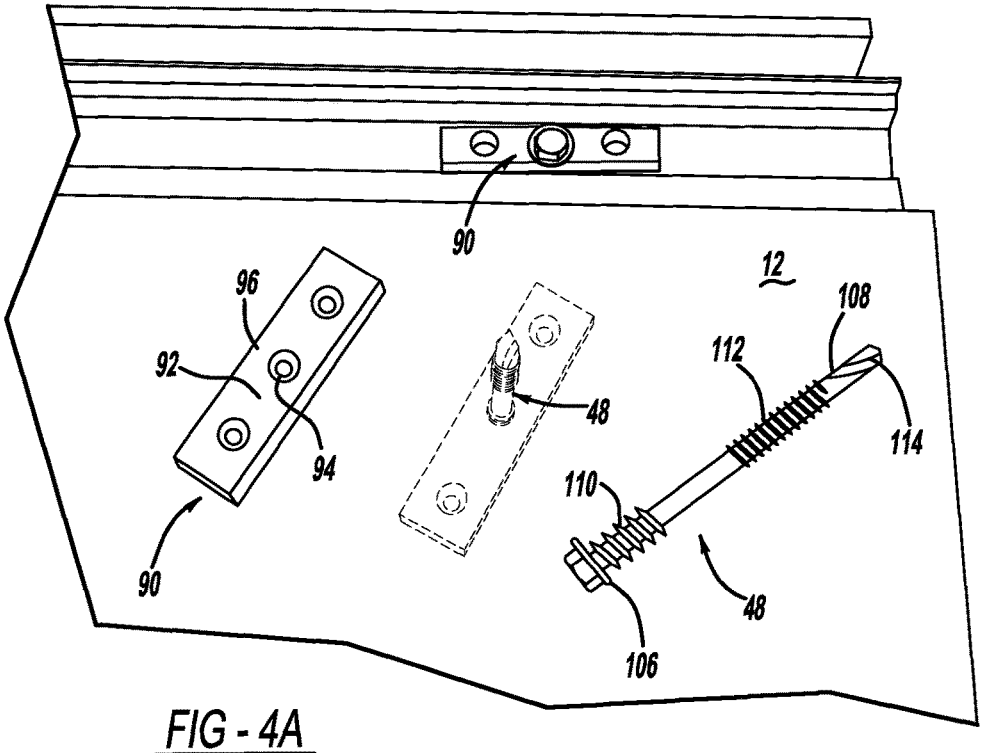
FIG. 4A is a perspective view of a joint clip on the panel.
Figure 4B:
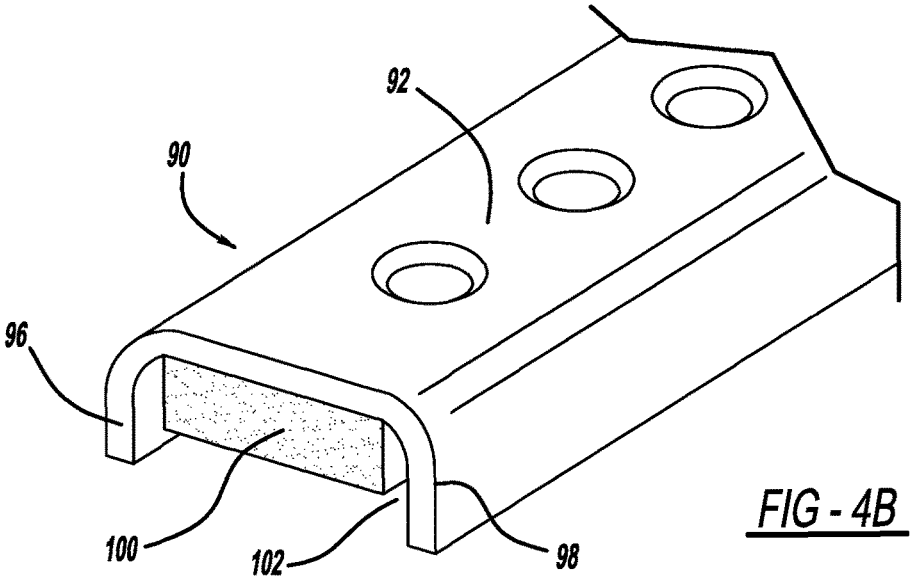
FIG. 4B is a top perspective view of the joint clip.
Figure 4C:
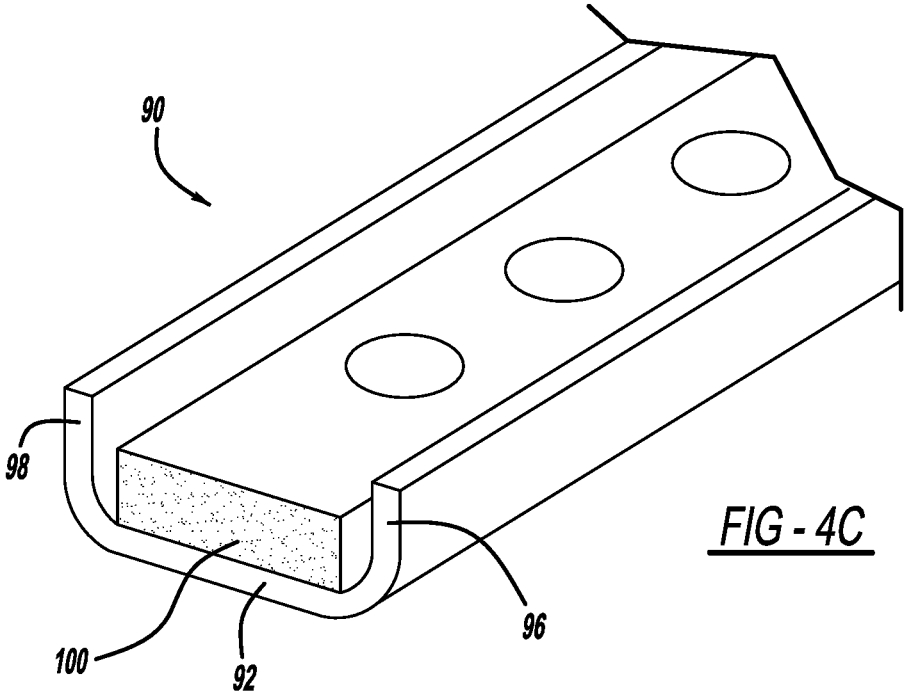
FIG. 4C is a bottom perspective view of the joint clip.
Figure 4D:
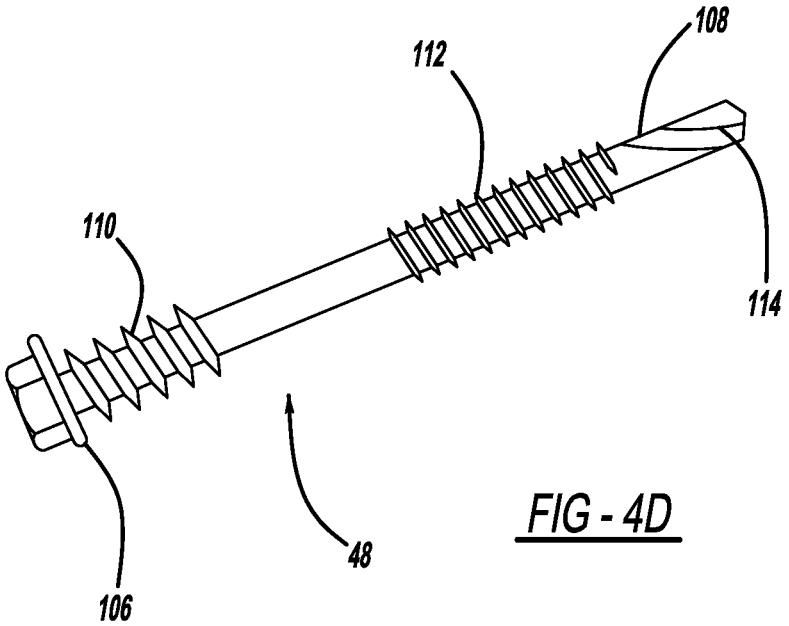
FIG. 4D is a perspective view of the fastener for the joint clip.

As can be seen in FIGS. 2 and 3, a plurality of panels 12 is stacked upon one another with the first ends 28, 68 of the outer and inner sheet and the second ends 30, 70 of the outer and inner sheets, respectively mating with one another to provide a sealing arrangement between the adjacent panels 12. Also, the fasteners 48 are passed through the panels 12 to secure the panels 12 with the frame 16. The fastener heads 106 are positioned in the indented fastener receiving portion 40 so that they are hidden and cannot be seen by a viewer. Additionally, the indented fastener receiving portion provides a gutter for the panel.

Turning to FIGS. 4A-4D, a panel clip 90 is illustrated on the panel 12. The panel clip 90 includes a base 92 with at least one aperture 94, three are shown. The base 92 includes a pair of sidewalls 96, 98 that are positioned with respect to the longitudinal axis of the base 92. A resilient pad 100 is positioned in the cavity 102 formed between the interior of the base 92 and walls 96, 98. The pad 100 seals the fastener 48 that passes through the clip 90 and panel 12 as illustrated in FIG. 3.

The fastener 48 includes a head 106 and a shank 108. The shank 108 includes a first threaded portion 110 and a second threaded portion 112. Also, the shank 108 includes a self-tapping pilot tip 114. The first threaded portion 110 is positioned immediately adjacent the head 106. The first threaded portion 110 has a larger diameter than that of the second threaded portion 112. The first threaded portion 110 tightens against the panel clip base 92 to stop overdriving of the fastener 48. The second threaded portion 112 fixes into the frame 16 to secure the fastener 48 with the frame 16 and secure the panel 12 onto the frame 16. The self-tapping pilot tip 14 is a bi-metal carbon tip to provide ease of drilling coupled with timeless corrosion resistance. Additionally, the non-threaded shank portion 108 between the two threaded portions 110, 112 prevents panel jacking.

While one panel clip 90 is illustrated, it is understood that a plurality of panel clips 90 are utilized to retain the panel 12 onto the frame structure 16.

Figure 5:
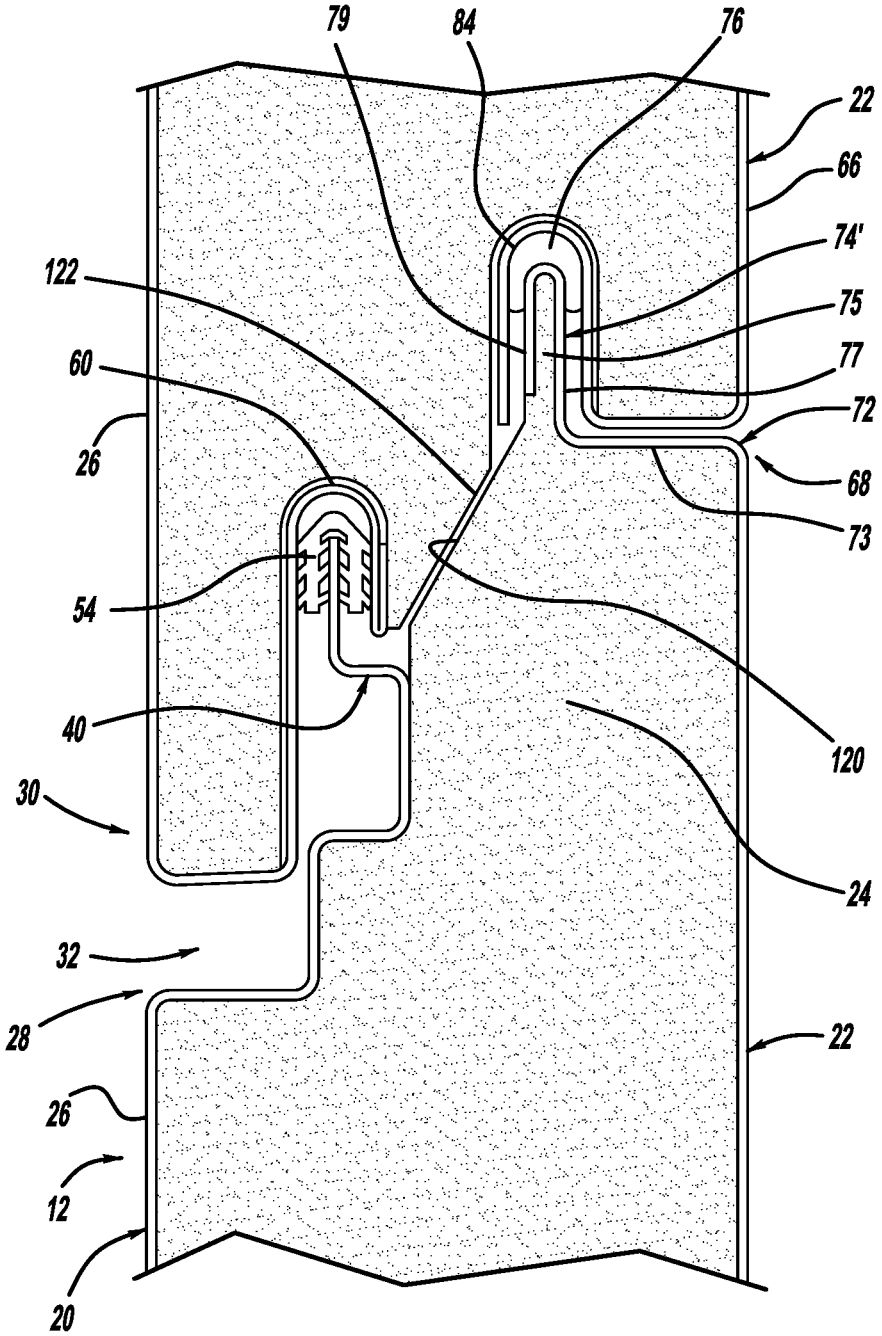
FIG. 5 is a cross section view like FIG. 3 of a second embodiment.

FIG. 5 illustrates an additional embodiment of the building panel 12'. FIG. 5 is similar to that of FIG. 3. The difference is in the foam surfaces positioned between the seal holding flanges. Thus, the elements that are the same as those previously discussed are identified with the same numerals.

Here, the skin 20 is the same as that previously described. The skin 22 differs in the first or male end. The major surface 66, first end 68 terminates at a step portion 72. The step portion 72 has a tread 73. The riser 74', extending from the tread 73, has a U-shape configuration with a gap 75 between the legs 77, 79. The gap 75 receives foam 24. The panel first end foam surface 120 between the outer skin contour portion 32 and the inner skin step portion 72 is tapered or angled. The panel second end mating foam surface 122 is tapered on an angle substantially the same as that of surface 120. Thus, when the panels 12 are positioned together, the foam 24 of adjacent panels 12 is continuous with one another providing for continuous insulation. Thus, maximum energy efficiency is obtained.

The description of the disclosure is merely exemplary in nature and thus, variations that do not depart from the gist of the disclosure are intended to be within the scope of the disclosure. Such variations are not to be regarded as a departure from the spirit and scope of the disclosure.

What is claimed is:

1. A building panel comprising:

an outer skin spaced from an inner skin, an insulation material positioned between the outer skin and the inner skin forming the building panel;

a first end of the outer skin including a contoured portion, the contoured portion extending from a first surface of the outer skin, the contoured portion includes a step portion, an indented fastener receiving portion and a first flange, the first flange extends outwardly from the indented fastener receiving portion toward the first surface of the outer skin;

a first seal mounted on the first flange;

the inner skin including a first end positioned adjacent the first end of the outer skin, the inner skin first end includes a shelf and a second flange, the shelf extends toward the outer skin from a first surface of the inner skin, the second flange extends from the shelf, the second flange extends in a same direction as the outer skin first flange;

a second seal is positioned on the second flange of the inner skin;

a second end of the outer skin includes a first receiver portion for receiving an adjoining panel outer skin first end; and a second end of the inner skin includes a second receiver portion for receiving the adjoining panel inner skin first end.

2. The building panel of claim 1, wherein the indented fastener receiving portion has a depth to receive a fastener head so that the head is at least flush with a plane passing through the first flange of the outer skin.

3. The building panel of claim 1, wherein the insulation terminates at the inner skin shelf with the inner skin second flange on one side of the shelf and the outer skin first flange on another side of the shelf.

4. The building panel of claim 1, wherein the outer skin contoured portion includes a second step adjacent the first step for concealing a fastener head from view.

5. The building panel of claim 1, wherein the indented fastener receiving portion provides a gutter.

6. The building panel of claim 1, wherein the indented fastener receiving portion is positioned adjacent an end of the insulation at the second end of an adjoining panel.

7. A building wall comprising:

a plurality of insulated panels stacked one upon another to form the building wall;

each insulated panel comprising:

an outer skin spaced from an inner skin, an insulation material positioned between the outer skin and the inner skin forming the building panel;

a first end of the outer skin including a contoured portion, the contoured portion, extending from a first surface of the outer skin, the contoured portion includes a step portion, an indented fastener receiving portion and a first flange, the first flange extends outwardly toward the first surface of the outer skin;

a first seal mounted on the first flange;

the inner skin including a first end positioned adjacent the first end of the outer skin, the inner skin first end including a shelf and a second flange, the shelf extends toward the outer skin from a first surface of the inner skin, and the second flange extends from the shelf, the second flange extending in a same direction to the outer skin first flange;

a second seal is positioned on the second flange of the inner skin;

a second end of the outer skin includes a first receiver portion for receiving an adjoining panel outer skin first end; and a second end of the inner skin includes a second receiver portion for receiving the adjoining inner skin first end of the adjoining panel.

8. The building panel of claim 7, wherein the indented fastener receiving portion has a depth to receive a fastener head so that the head is at least flush with a plane passing through the first flange of the outer skin.

9. The building panel of claim 7, wherein the insulation terminates at the inner skin shelf with the inner skin second flange on one side of the shelf and the outer skin first flange on another side of the shelf.

10. The building panel of claim 7, wherein the outer skin contoured portion includes a second step adjacent the first step for concealing a fastener head from view.

11. The building panel of claim 7, wherein the indented fastener receiving portion provides a gutter.

12. The building panel of claim 7, wherein the indented fastener receiving portion is positioned adjacent an end of the insulation at the second end of an adjoining panel.

* * * * *